US007040335B1

(12) United States Patent
Ransom

(10) Patent No.: US 7,040,335 B1
(45) Date of Patent: May 9, 2006

(54) SCENT CONTAINMENT SYSTEM FOR HUNTING BLINDS

(75) Inventor: Robert M. Ransom, Flushing, MI (US)

(73) Assignee: Ameristep, Inc., Clio, MI (US)

( * ) Notice: Subject to any disclaimer, the term of this patent is extended or adjusted under 35 U.S.C. 154(b) by 40 days.

(21) Appl. No.: 10/163,390

(22) Filed: Jun. 5, 2002

Related U.S. Application Data

(60) Provisional application No. 60/297,700, filed on Jun. 12, 2001.

(51) Int. Cl.
*E04H 15/58* (2006.01)
*F41H 3/00* (2006.01)

(52) U.S. Cl. ..... 135/901; 43/1; 135/117; 135/126; 135/128; 428/919

(58) Field of Classification Search ..... 135/117, 135/901, 126, 128; 43/1; 52/202, DIG. 13; 428/919
See application file for complete search history.

(56) References Cited

U.S. PATENT DOCUMENTS

| | | | | |
|---|---|---|---|---|
| 2,854,705 | A * | 10/1958 | McClaran | 52/206 |
| 3,826,270 | A * | 7/1974 | Hentges | 280/19.1 |
| 4,364,193 | A * | 12/1982 | Visco | 43/1 |
| 4,777,755 | A * | 10/1988 | Colburn | 43/1 |
| 4,794,717 | A | 1/1989 | Horsmann | |
| 5,172,525 | A * | 12/1992 | Cook | 52/71 |
| 5,377,711 | A | 1/1995 | Mueller | |
| 5,622,198 | A * | 4/1997 | Elsinger | 135/128 |
| 5,749,387 | A * | 5/1998 | Thompson | 135/146 |
| 5,983,913 | A | 11/1999 | Fargason | |
| 6,021,794 | A * | 2/2000 | Guerra | 135/95 |
| 2004/0084076 | A1 * | 5/2004 | Coursey | 135/901 |

* cited by examiner

*Primary Examiner*—Robert Canfield
(74) *Attorney, Agent, or Firm*—Young & Basile, P.C.

(57) ABSTRACT

The invention is a scent containment system for hunting blinds. A hunting blind is provided with scent impervious walls and removable light transmissive scent impervious windows. The scent impervious windows are remarkable in that they are designed to be readily penetrable by a projectile such as an arrow or a bullet, and are of low cost and disposable.

2 Claims, 3 Drawing Sheets

SCENT CONTAINMENT SYSTEM FOR HUNTING BLINDS

RELATED APPLICATIONS

This application is related to, and claims the benefit of priority from, U.S. Provisional Patent Application Ser. No. 60/297,700, filed Jun. 12, 2001.

FIELD OF THE INVENTION

This invention relates to enclosures used as hunting blinds, and more particularly, to scent containment windows for hunting blinds to reduce the transmission of odors which might alert game to the presence of hunters.

BACKGROUND OF THE INVENTION

Hunters of wild game frequently employ enclosures to provide the hunter with protection from the elements, as well as to camouflage the hunter's presence from potential game. Such hunting enclosures include permanent, semi-permanent and collapsible, transportable structures which are placed in or near the natural habitat of the game being hunted. Hunting blinds come in a wide variety of shapes and sizes, often particularly adapted for a particular outdoor environment, and for the hunting of a particular type of wildlife. Such enclosures often take the form of tents which may be mounted on the ground or on an elevated platform, such as a tree stand.

While the use of such enclosures is well-known for protection of the occupant from both the elements and from observation, such enclosures create certain impediments to the actual process of shooting at wild game in the proximity of the enclosure. It is a desirable feature of such enclosures that the occupant be able to rapidly exit the enclosure, or to allow a portion of the hunter's weapon to protrude from an opening in the enclosure. One approach to this desired goal is depicted in U.S. Pat. No. 4,794,717, issued to Horsmann, showing an enclosure having readily removable transparent covers for openings formed in the walls of the enclosure. Horsmann teaches an enclosure which is openable to permit the extension of a portion of the hunter's body and provides for sighting slots which may be easily covered and uncovered.

The openings taught by Horsmann, however, are intended to be removed to allow the hunter's body to partially protrude through the wall of the enclosure, and are not designed for penetration by a projectile. The coverings must be periodically opened and closed, which further introduces the problem of the transmission of human scent into the surrounding habitat.

A somewhat different approach is taught by Mueller, in U.S. Pat. No. 5,377,711. Mueller teaches a skeletal-type framework which is surrounded by camouflage netting. While Mueller specifically teaches that the netting is designed to be penetrable by a projectile, it is also apparent that the same netting, while obscuring the hunter from the view of wild game, readily permits the flow of air through the enclosure, allowing the scent of the hunter and his equipment to be transmitted to the surrounding air outside the enclosure.

The importance of concealing or redirecting human scent from the natural habitat of the wild game is demonstrated by Fargason in U.S. Pat. No. 5,983,913, which teaches the use of a venting system for hunting blinds which insures the dispersal of the scents from within a hunting blind to a substantial height above the ground. This technique, however, is only marginally effective, in that odors released from the hunting blind, even at a substantial height, can easily be redirected by atmospheric conditions to ground level. Also, even if such scents are successfully dispersed away from the hunting blind, wild game can frequently sense human scent from great distances, and will avoid such areas by a wide margin, making the use of ventilating pipes only slightly effective.

There is therefore a need for a hunting blind having scent containment features, and which further permits the utilization of a weapon from within the blind without the necessity for the hunter leaving the blind or breaching the integrity of the enclosure prior to operating a weapon.

SUMMARY OF THE INVENTION

It is an object of the present invention to provide a hunting blind providing concealment of a human occupant from wild game.

It is further an object of the invention to provide a hunting blind which will camouflage the presence of a person in a wild habitat by containing within an enclosure substantially all of the scents associated with humans and their equipment. It is further an object of the invention to provide a hunting blind which will camouflage the presence of a person from the visual observation of game.

It is a further object of the present invention to provide a hunting blind to contain the scents of a human and his equipment while still permitting the operation of a weapon, such as the discharge of firearm or the operation of a bow and arrow, allowing for the firing the projectile of the weapon through an element which is readily permeable to a projectile, but substantially impermeable to the transmission of scents.

More particularly, according to the present invention, there is provided a hunting blind which will enclose a hunter, but conceal the hunter's scent in the natural habitat of wild game, the hunting blind comprising an enclosure having top, bottom and sides, and one or more openings having removably affixed thereto scent-impermeable but optically transmissive coverings through which a projectile can be fired. The coverings are preferably removable and reinstallable, and manufactured of inexpensive and readily disposable material, which can be easily replaced following penetration by a projectile.

BRIEF DESCRIPTION OF THE DRAWINGS

The objects of the invention will be best understood by reference to the attached drawings in which.

DESCRIPTION OF THE PREFERRED EMBODIMENT

Figure 1:
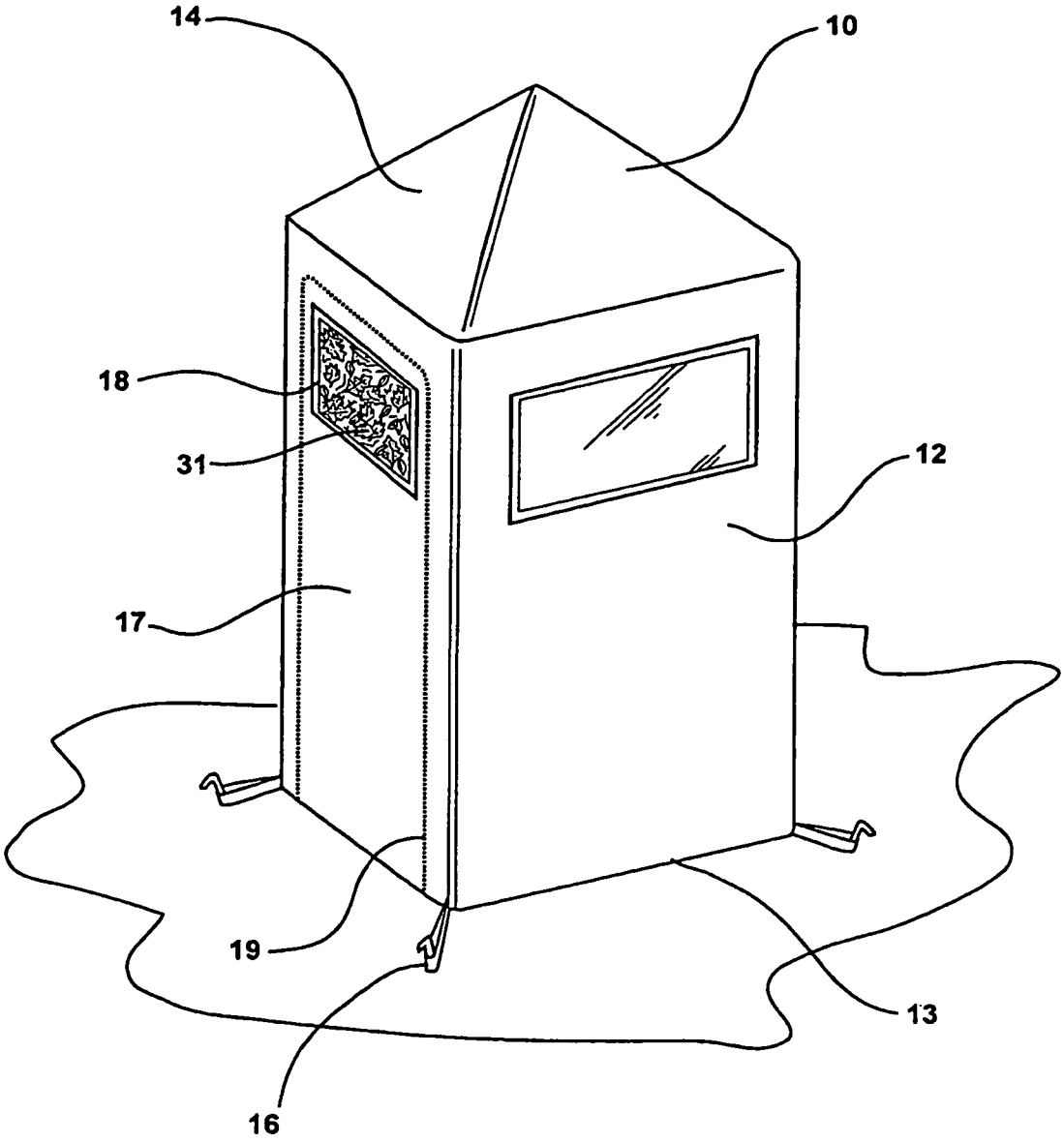
FIG. 1 is a perspective view of the blind according to the present invention.
Figure 2:
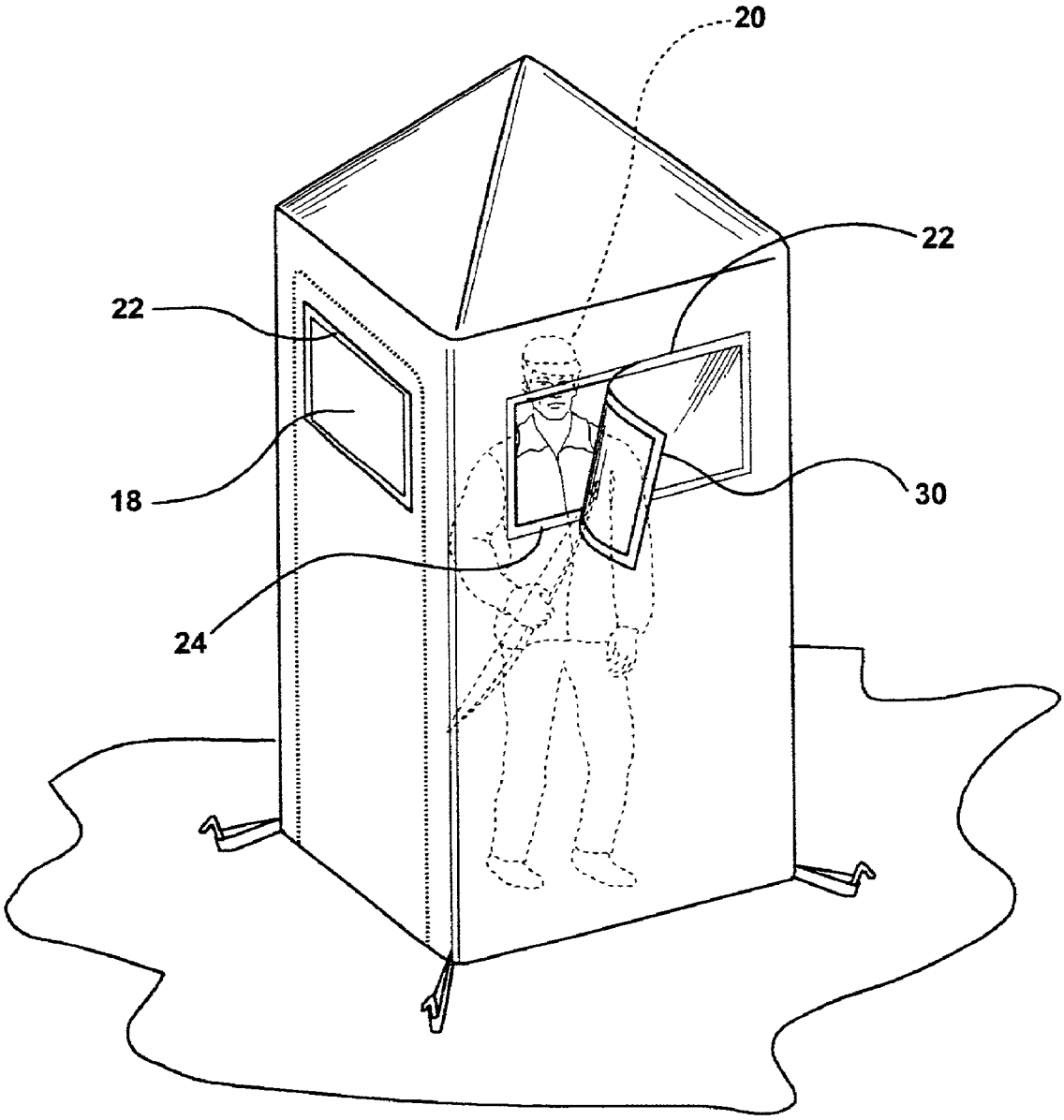
FIG. 2 is a perspective and detailed view of the elements of the invention showing the placement and removability of window coverings for the enclosure.

With reference to FIGS. 1 and 2, the present invention, a scent containment system for hunting blinds, comprises an enclosure 10 having a plurality of side walls 12, a roof 14, a base 13, a plurality of coverable openings 18, and preferably a plurality of securing points 16.

In one embodiment, side walls 12, roof 14 and base 13 are constructed around a framework (not shown) which may be integral with or separate from fabric or other material forming the side walls 12, roof 14 and base 13. The enclosure 10 may be formed of rigid panels, so that the base 13, side walls 12 and roof 14 are rigid and self-supporting. Regardless of the structure of enclosure 10, however, the composition of side walls 12, base 13 and roof 14 is such that these elements of the enclosure are relatively impervious to the transmission of scent. Suitable rigid materials for an enclosure might include, for example, plywood, wax-coated corrugated board, or lightweight plastics. Similarly, the side walls 12, roof 14 and base 13 of enclosure 10 may be manufactured from flexible materials, such as low porosity Dacron, Mylar film, low porosity nylon or coated canvas. As shown in FIGS. 1 and 2, the roof 14, side walls 12 and base 13 are arranged to form an enclosure for an occupant 20, thereby providing both protection from the elements and a scent-free barrier to insure that scents within the enclosure are not transmitted to the environment outside the enclosure. To permit the occupant 20 to both observe and shoot game through openings 18, light transmitting windows 30 are removably attached to side walls 12 at window edge 22. Windows 30 are preferably transparent, but may be semi-transparent, and may contain one or more camouflaging patterns 31. In the preferred embodiment, the material of side walls 12 and roof 14 are provided with either a brightly contrasting color, such as hunter's orange, which is readily visible to humans, or provided with a coloring or pattern designed to allow the enclosure 10 to blend in with the foliage or other background of the surrounding habitat. Each opening 18 is provided with a frame base 24 adapted to provide a securing point and support for edges 22 of window 30. To permit the user ingress and egress to and from the interior of the enclosure 10, at least one side wall 12 is provided with a door 17 and a closure for said door 19. Typically, in a structure having flexible side walls, the door 17 is formed as a cutout from the fabric of the side wall 12 and the closure is a zipper, hook and loop fastener, array of snaps, or similar well known mechanism of closure for such an enclosure.

Figure 3:
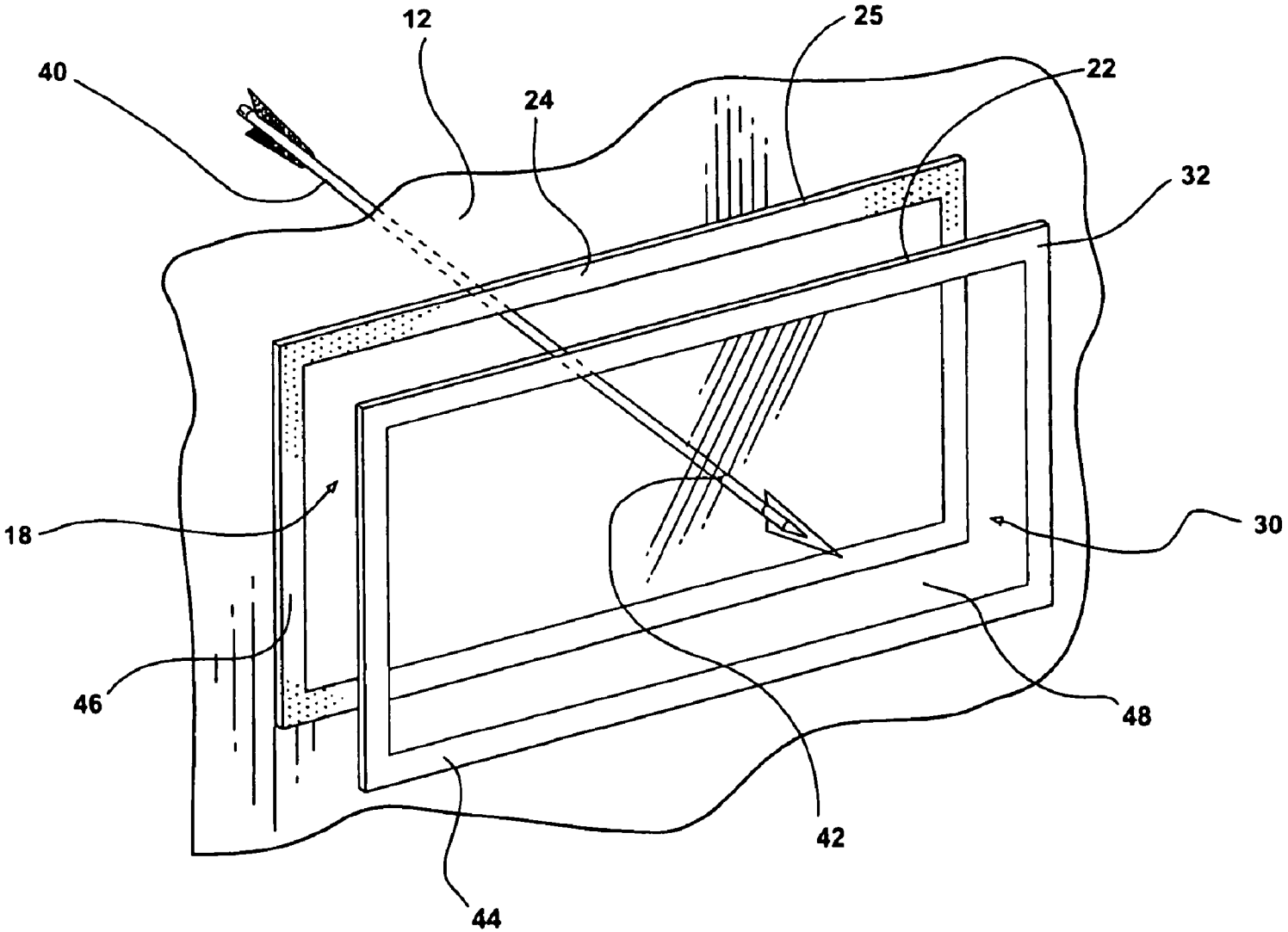
FIG. 3 is a detailed view of the window coverings for the enclosure showing its attachment and relationship to the wall of the enclosure.

As shown in more detail in FIG. 3, in one embodiment, window 30 is constructed of a lightweight low-cost light transmissive material such as cellophane or thin Mylar. Ideally, the window 30 will have a thickness of less than 0.030 inch. The thickness of the material is selected within this range to insure that it is readily permeable by a projectile, such as a hunter's arrow or bullet without preventing any significant obstacle to the passage of said projectile. Likewise, the material is selected from that class of relatively low cost materials, inasmuch as the puncturing of the light transmissive portion 48 of the window 30 by a projectile 40 perforates the window. The window 30 is preferably selected from a class of materials which are impervious to scent.

As shown in FIG. 3, window 30 is placed over opening 18 by affixing the window perimeter 32 by aligning window edge 22 with frame base edge 25, thereby aligning the circumference of the window perimeter 32 with the circumference of the frame base 24. In one embodiment, window 30 is provided with a first fastening surface 44 and frame base 24 is provided with a second fastening surface 46. First fastening surface 44 surrounds the entire window perimeter 32 of light transmitting portion 48 of window 30 on the side facing the enclosure wall 12. Second fastening surface 46 is affixed to the perimeter of the frame base 24 on the outside of wall 12. In a typical embodiment, first fastening surface 44 and second fastening surface 46 are complimentary materials which may be drawn from a well-known selection of complimentary mating materials, such as hook and loop fasteners, zippers, low tack adhesives, strip magnets and the like. First fastening surface 44 and second fastening surface 46 are preferably continuous to insure that placement of first fastening surface 44 against second fastening surface 46 insures a relatively air-tight seal between window 30 and enclosure wall 12.

Accordingly, in the preferred embodiment, each opening 18 in enclosure 10 is provided with a light transmissive window 30 affixed to the walls 12 of enclosure 10 by a plurality of fastening surfaces 44 and 46 in such a manner as to provide a complete and relatively air-tight structure having closed windows which prevent the escape of scents from within the structure to the surrounding habitat. Because windows 30 are light-transmissive, the occupant 20 is free to observe game in the surrounding environment. Likewise, as can be seen in FIG. 3, an arrow, bullet or other projectile may be fired from within the enclosure in the direction of the arrows A, whereby the projectile 40 punctures the window 30 at puncture point 42. Puncture point 42 is shown for descriptive purposes only, in reality any or all of the light-transmitting portion 48 of the window 30 is readily puncturable by a projectile. Furthermore, because the windows 30 are manufactured of inexpensive and disposable materials, after a window 30 has been penetrated by a projectile, it may be easily removed by separating first fastening surface 44 from second fastening surface 46 and replaced with a fresh window 30. By selection of appropriate fastening means for fastening surfaces 44 and 46, the replacement of a punctured window 30 may be done quickly, without the need for any tools, and without significant expense. According to the invention, therefore, the scent containment characteristics of the enclosure may be preserved by replacing the appropriate windows 30, through which projectiles 40 have been fired.

It is to be understood that the present invention is not limited to the embodiments described above, but encompass any and all embodiments within the scope of the following claims:

I claim:

1. A collapsible hunting blind, comprising:

a plurality of walls fabricated from a flexible material;

a roof fabricated from a flexible material;

a framework supporting the plurality of walls;

a door mounted in one of the walls;

portions of one or more of the walls defining perimeters of a plurality of openings, each of the perimeters having a substantially continuous first fastening surface; and a plurality of substantially transparent windows corresponding to the plurality of openings, wherein each of the substantially transparent windows has a perimeter with a substantially continuous second fastening surface removably engageable with the corresponding substantially continuous first fastening surface and wherein each of the substantially transparent windows is substantially impervious to the transmission of scent and readily penetrable by the projectile of a weapon, and having a visible camouflage pattern on each of the substantially transparent windows.

2. A collapsible hunting blind, comprising:

a plurality of walls, a roof, a portion of one or more of the walls defining a perimeter of at least one opening, and at least one substantially transparent window attached to the perimeter of the at least one opening wherein the at least one substantially transparent window is substantially impervious to the transmission of scent and readily penetrable by the projectile of a weapon, and having a visible camouflage pattern on the at least one substantially transparent window.

* * * * *